US010181369B2

(12) United States Patent
Toda

(10) Patent No.: US 10,181,369 B2
(45) Date of Patent: Jan. 15, 2019

(54) NTC THERMISTOR TO BE EMBEDDED IN A SUBSTRATE, AND METHOD FOR PRODUCING THE SAME

(71) Applicant: Murata Manufacturing Co., Ltd., Nagaokakyo-shi, Kyoto-fu (JP)

(72) Inventor: Kei Toda, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 15/679,332

(22) Filed: Aug. 17, 2017

(65) Prior Publication Data

US 2018/0130577 A1 May 10, 2018

Related U.S. Application Data

(63) Continuation of application No. PCT/JP2016/051154, filed on Jan. 15, 2016.

(30) Foreign Application Priority Data

Mar. 4, 2015 (JP) ..... 2015-042920

(51) Int. Cl.
*H01C 7/04* (2006.01)
*H01C 1/14* (2006.01)
*H01C 17/28* (2006.01)

(52) U.S. Cl.
CPC ..... *H01C 7/046* (2013.01); *H01C 1/1413* (2013.01); *H01C 7/04* (2013.01); *H01C 17/28* (2013.01)

(58) Field of Classification Search
CPC ..... H01C 7/046; H01C 1/1413; H01C 17/28
(Continued)

(56) References Cited

U.S. PATENT DOCUMENTS 6,166,620 A * 12/2000 Inuzuka ..... H01C 17/06533 338/308
2003/0112116 A1* 6/2003 Fujimoto ..... H01C 7/04 336/200
(Continued)

FOREIGN PATENT DOCUMENTS

JP 09-17607 A 1/1997
JP 2000-106304 A 4/2000
(Continued)

OTHER PUBLICATIONS

JP 09-17607, Fukuyama, Jan. 1997. Machine translation.*
(Continued)

*Primary Examiner* — Kyung S Lee
(74) *Attorney, Agent, or Firm* — Keating & Bennett, LLP

(57) ABSTRACT

An NTC thermistor to be embedded in a substrate includes a thermistor body that is a ceramic sintered body and includes two opposed main surfaces, two opposed side surfaces, and two opposed end surfaces, a plurality of internal electrodes provided inside the thermistor body, and two external electrodes provided on outer surfaces of the thermistor body, and electrically connected to the plurality of internal electrodes. Each of the external electrodes includes a first electrode layer covering one of the end surfaces of the thermistor body, a second electrode layer provided on each of the main surfaces of the thermistor body, the second electrode layer including at least one layer, one end of the second electrode layer being in contact with the first electrode layer, and another end thereof extending in a direction of another end surface, and a third electrode layer including at least one layer and covering the first electrode and the second electrode layers.

20 Claims, 5 Drawing Sheets

(58) Field of Classification Search
USPC ..... 338/22 R, 12
See application file for complete search history.

(56) References Cited

U.S. PATENT DOCUMENTS

| | | | | |
|---|---|---|---|---|
| 2009/0108984 | A1* | 4/2009 | Choi | H01C 17/06533 338/22 R |
| 2009/0284896 | A1 | 11/2009 | Sakaguchi et al. | |
| 2010/0039749 | A1 | 2/2010 | Ritter et al. | |
| 2010/0128411 | A1* | 5/2010 | Onishi | H01G 4/232 361/302 |
| 2013/0229256 | A1* | 9/2013 | Miura | H01C 7/043 338/22 R |
| 2014/0333411 | A1 | 11/2014 | Yoneda | |
| 2016/0027561 | A1* | 1/2016 | Inoue | H01G 4/30 338/20 |

FOREIGN PATENT DOCUMENTS

| | | | |
|---|---|---|---|
| JP | 2009-253010 | A | 10/2009 |
| JP | 2010-045372 | A | 2/2010 |
| JP | 2013-183109 | A | 9/2013 |
| WO | 2013/099572 | A1 | 7/2013 |

OTHER PUBLICATIONS

JP 2016-031989, Inoue, Mar. 2016. Machine translation.*
Official Communication issued in International Patent Application No. PCT/JP2016/051154, dated Mar. 15, 2016.

* cited by examiner

NTC THERMISTOR TO BE EMBEDDED IN A SUBSTRATE, AND METHOD FOR PRODUCING THE SAME

CROSS REFERENCE TO RELATED APPLICATIONS

This application claims the benefit of priority to Japanese Patent Application No. 2015-042920 filed on Mar. 4, 2015 and is a Continuation Application of PCT Application No. PCT/JP2016/051154 filed on Jan. 15, 2016. The entire contents of each application are hereby incorporated herein by reference.

BACKGROUND OF THE INVENTION

1. Field of the Invention

The present invention relates to an NTC thermistor to be embedded in a substrate and a method for producing the same, and more particularly, to an NTC thermistor to be embedded in a substrate for use in a component-embedded substrate, and a method for producing the same.

2. Description of the Related Art

In recent years, with increased demand for downsizing of electronic equipment, downsizing and reduction in height of an electronic component, such as an NTC thermistor and the like, embedded in a component-embedded substrate has progressed. FIG. 5 is a schematic view showing an example of a chip type NTC thermistor. An NTC thermistor 100 is made of a ceramic sintered body, and has a thermistor body 102 made of a ceramic sintered body, and having a pair of opposed end surfaces, a plurality of internal electrodes 101*a*, 101*b*, 101*c*, 101*d* formed inside the thermistor body 102, and a pair of external electrodes 105, 106 formed on a pair of end surfaces of the thermistor body 102, respectively. The external electrode 105 has a structure in which plated films 104*a*, 104*b* are laminated on an end surface electrode 103*a*. Moreover, the external electrode 106 has a structure in which plated films 104*c*, 104*d* are laminated on an end surface electrode 103*b* (see, e.g., JP2000-106304 A).

The above-described NTC thermistor is disposed in the component-embedded substrate, and an inside of the substrate is filled with insulating resin to embed the NTC thermistor. Generally, electrical connection between the embedded NTC thermistor and wiring is performed through a via hole electrode. For example, laser light is emitted to the insulating resin while directing the laser light to the external electrode of the NTC thermistor to form a via hole. Further, the via hole is filled with a metal conductor to electrically connect the relevant external electrode of the NTC thermistor and the wiring.

However, in the case where the conventional NTC thermistor is used, in forming the via hole with the laser light, the laser light needs to be accurately emitted on the relevant external electrode, such that the thermistor body of the NTC thermistor is not damaged. Therefore, when emitting the laser light, an extremely high accuracy of position with respect to the NTC thermistor is required, so that there is a problem that producing processes of the electronic equipment are complicated.

SUMMARY OF THE INVENTION

Preferred embodiments of the present invention provide NTC thermistors to be embedded in a substrates that do not require an extremely high accuracy of position to form a via hole with laser light, and a method for producing the same.

An NTC thermistor to be embedded in a substrate according to a preferred embodiment of the present invention includes a thermistor body that is a ceramic sintered body, and including two opposed main surfaces, two opposed side surfaces, and two opposed end surfaces; a plurality of internal electrodes provided inside the thermistor body; and two external electrodes provided on outer surfaces of the thermistor body, and electrically connected to the plurality of internal electrodes. Each of the external electrodes includes a first electrode layer covering one of the end surfaces of the thermistor body; a second electrode layer including at least one layer and provided on each of the main surfaces of the thermistor body, one end of the second electrode layer being in contact with the first electrode layer, and another end thereof extending in a direction of another end surface; and a third electrode layer including at least one layer and covering the first electrode and the second electrode layers.

For each of the second electrode layers, a sputtering film of at least one layer may preferably be used. This is able to produce a flat electrode film.

For the third electrode layer, a plated film may preferably be used. This is able to prevent burning of the external electrode during the laser light emission.

For the first electrode layer, a layer obtained by applying and firing a conductive paste may preferably be used. This enables the end surfaces to be completely covered.

It is preferable that the second electrode layers are flatter than the first electrode layer. This enables the third electrode layer to be formed flatter, and prevents the generation of an unnecessary gap between the NTC thermistor and the sealing body when mounting on a component-embedded substrate described later. Moreover, the directivity of reflected light of a laser becomes stable, and a shape of a via hole also becomes stable.

The thermistor body may preferably include a non-covered region that is not covered with the external electrodes in outer surfaces at a center portion thereof, and the non-covered region may preferably include a step that is lower than a covered region covered with the external electrodes.

The NTC thermistor to be embedded in a substrate of a preferred embodiment of the present invention may preferably be produced, for example, using the following production method. In one method for producing an NTC thermistor to be embedded in a substrate according to a preferred embodiment of the present invention, a step of forming each of the external electrodes includes a step of forming a first electrode layer covering one end surface of a thermistor body, a step of forming a second electrode layer in each main surface of the thermistor body, the second electrode layer including at least one layer, one end of the second electrode layer being in contact with the first electrode layer, and another end thereof extending in a direction of another end surface, and a step of forming a third electrode layer including at least one layer and covering the first electrode layer and the second electrode layers. According to the above-described production method, the NTC thermistor to be embedded in a substrate is able to be produced, which does not require an extremely high accuracy of positioning when the via hole is formed by the laser light.

The step of forming the third electrode layer is preferably a step of forming the third electrode layer by a plating method, and after forming the second electrode layers, for the non-covered region that is the outer surfaces at the central portion of the thermistor body and is not covered with the second electrode layers, removal of the body surface portion may preferably be performed by oxide treatment, polishing treatment, plating treatment, or grinding treatment, for example. This reduces or prevents the occurrence of island-shaped plating at the central portions of the thermistor body during the plating treatment for forming the third electrode layer.

In the step of forming the second electrode layer, it is preferable to form the second electrode layer so as to be flatter than the first electrode layer. This enables the third electrode layer to be formed flatter, and prevents the generation of an unnecessary gap between the NTC thermistor and the sealing body when mounting on the component built-in type substrate described later. Moreover, the effects of a stabilization of directivity of the reflected light of the laser and a stabilization of the shape of via hole is able also be obtained.

According to various preferred embodiments of the present invention, NTC thermistors to be embedded in substrates which do not require an extremely high accuracy of position when a via hole is formed by laser light are provided.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
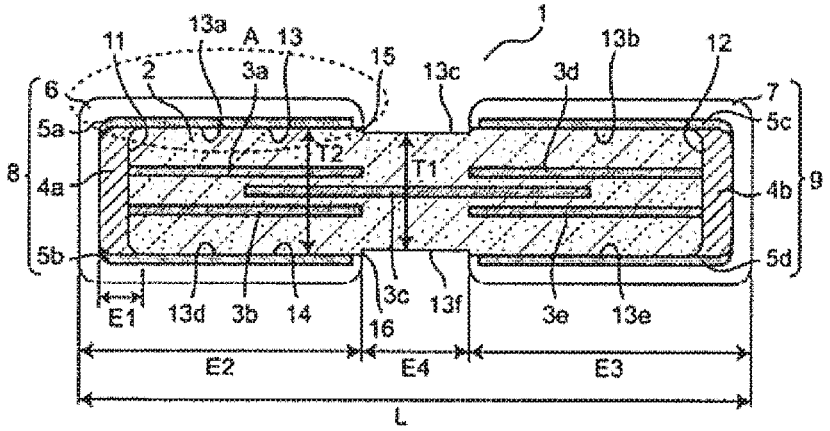
FIG. 1 is a schematic longitudinal cross-sectional view showing a structure of an NTC thermistor to be embedded in a substrate according to a preferred embodiment of the present invention.

Hereinafter, referring to the drawings, preferred embodiments of the present invention will be described in detail.

An NTC thermistor to be embedded in a substrate according to a preferred embodiment of the present invention includes a thermistor body that is a ceramic sintered body, and including two opposed main surfaces, two opposed side surfaces, and two opposed end surfaces, a plurality of internal electrodes provided inside the thermistor body, and two external electrodes provided on outer surfaces of the thermistor body and electrically connected to the plurality of internal electrodes, wherein each of the external electrodes includes a first electrode layer covering one of the end surfaces of the thermistor body, a second electrode layer provided on each of the main surfaces of the thermistor body, the second electrode layer including at least one layer, one end of the second electrode layer being in contact with the first electrode layer, and another end thereof extending in a direction of another end surface, and a third electrode layer including at least one layer and covering the first electrode and the second electrode layers.

FIG. 1 is a schematic cross-sectional view showing a structure of an NTC thermistor according to a preferred embodiment of the present invention. An NTC thermistor 1 includes a thermistor body 2 preferably made of a rectangular or substantially rectangular parallelepiped ceramic sintered body. The thermistor body 2 includes two opposed main surfaces 13, 14, two opposed side surfaces (not shown), and two opposed end surfaces 11, 12. Sizes of the two main surfaces may be the same as one another, or may be different from one another. Moreover, sizes of the two side surfaces may be the same as one another, or may be different from one another. Further, sizes of the two end surfaces may be the same as one another, or may be different from one another.

Inside the thermistor body 2, a plurality of internal electrodes 3*a*, 3*b*, 3*c*, 3*d*, 3*e* are disposed so as to overlap one another with thermistor body layers interposed therebetween. On outer surfaces of the thermistor body 2, two external electrodes 8, 9 are provided and are electrically connected to the plurality of internal electrodes 3*a*, 3*b*, 3*c*, 3*d*, 3*e*. The internal electrodes 3*a*, 3*b*, 3*c*, 3*d*, 3*e* are one preferred example, and the number of the internal electrodes is not particularly limited, as long as a plurality of internal electrodes are provided.

The ceramic sintered body of the thermistor body 2 is preferably made of ceramics having a negative resistance temperature characteristic. As the ceramics having the negative resistance temperature characteristics, appropriate ceramics conventionally used to make the NTC thermistor, for example, ceramics containing oxide of transition metal such as Mn, Ni, Fe, Ti, Co, Al, and Zn may preferably be used. Preferably, for example, ceramics containing manganese oxide as a principal component, and containing one or more of nickel oxide, cobalt oxide, alumina, iron oxide, and titanium oxide are used. Moreover, a shape of the thermistor body 2 is not particularly limited, as long as the thermistor body 2 includes the two corresponding end surfaces 11, 12, the two corresponding main surfaces 13, 14, and the two opposed side surfaces. While in FIG. 1, the example of the rectangular or substantially rectangular parallelepiped shape is described, a cube shape may also be provided, for example.

The internal electrodes 3*a*, 3*b* extend to the first end surface 11 of the thermistor body 2. Moreover, the internal electrodes 3*d*, 3*e* extend to the second end surface 12 opposed to the first end surface 11. The internal electrodes may preferably be formed by application and baking of a conductive paste. For the internal electrodes, a simple substance or an alloy of noble metal such as Ag, Pd, Pt, and Au or a base metal such as Cu, Ni, Al, W, and Ti may preferably be used.

On the outer surfaces of the thermistor body 2, the two external electrodes 8, 9 are provided. The first external electrode 8 includes a first electrode layer 4*a* covering the one end surface 11 of the thermistor body 2, two second electrode layers 5*a*, 5*b* provided on the respective main surfaces of the thermistor body 2, in each of which one end is in contact with the first electrode layer 4*a* and another end extends in a direction of the other end surface, and a third electrode layer 6 covering the first electrode layer 4*a* and the second electrode layers 5*a*, 5*b*. Moreover, the second external electrode 9 includes a first electrode layer 4*b* covering the one end surface 12 of the thermistor body 2, two second electrode layers 5*c*, 5*d* provided on the respective main surfaces of the thermistor body 2, in each of which one end is in contact with the first electrode layer 4*b* and another end extends in a direction of the other end surface, and a third electrode layer 7 covering the first electrode layer 4*b* and the pair of second electrode layers 5*c*, 5*d*.

The first electrode layers 4*a*, 4*b* include noble metal, such as Ag, Pd, Pt, and Au, and for example, are formed by application and baking of a conductive paste. Immersing the end surfaces of the thermistor body in the conductive paste allows the electrode layers covering the end surfaces to be easily formed. A thickness of each of the first electrode layers 4*a*, 4*b* is preferably about 10 μm or more and about 60 μm or less, more preferably about 10 μm or more and about 50 μm or less, and even more preferably about 15 μm or more and about 40 μm or less, for example. In this case, the thickness of each of the first electrode layers is a length between a joining position between the end surface and the main surface of the thermistor body and an outer surface of the first electrode layer (E1 in FIG. 1), and is the same or almost the same as the thickness of the first electrode layer.

The NTC thermistor is left standing at about 125° C. for about 1000 hours, and a reliability test is conducted to measure a change in resistance value after being left standing with respect to a resistance value before being left standing. The following results are obtained.

TABLE 1

| Thickness of first electrode layer (μm) | ΔR (%) |
|---|---|
| 35 | <1% |
| 10 | <1% |
| 5 | >1% |

Here, if a change in resistance value at about 25° C. after being left at about 125° C. with respect to a resistance value $R_{25}$ at about 25° C. before being left at about 125° C. is $\Delta R_{25}$, ΔR (%) is a value defined by the following formula.

$$(\Delta R25/R_{25})\times 100$$

It is indicated that when the value ΔR (%) is small, the resistance value change of the NTC thermistor is small. As is evident from the above-described results, it is confirmed that when the thickness of the first electrode layer is smaller than about 10 μm, the resistance value change increases, and that the reliability deteriorates.

Figure 2:
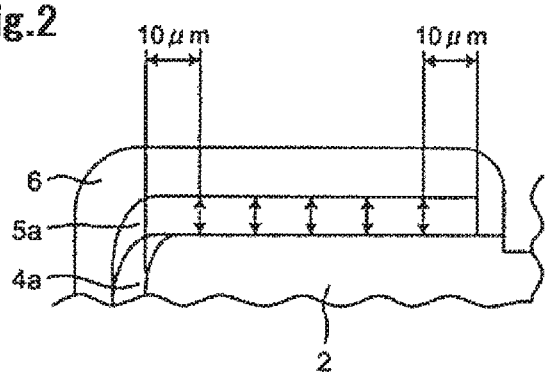
FIG. 2 is a partially-enlarged longitudinal cross-sectional view in FIG. 1.

For each of the second electrode layers, a single or a plurality of metal layers containing metal, preferably, Au, Ag, Cu, or Ti may be used. For the single layer or an outermost layer, Au or Ag, which is hard to oxidize, is preferably used. A thickness of each of the second electrode layers is preferably about 0.5 μm or more and about 10 μm or less, more preferably about 1 μm or more and about 10 μm or less, and even more preferably about 1.5 μm or more and about 5 μm or less, for example. It is preferable that the second electrode layers are flat. For example, an R value preferably is less than about 1 μm, and preferably less than about 0.5 μm. Here, the R value is an index indicating a degree of roughness of a surface. Referring to FIG. 2, a description will be provided. FIG. 2 is a partially-enlarged longitudinal cross-sectional view of an A portion in FIG. 1. The NTC thermistor is subjected to cross section polishing to measure the thickness of the second electrode layer 5*a* at five positions. A maximum value and a minimum value of the thicknesses at the five positions were determined, and a difference therebetween is defined as the R value. The smaller R value indicates that the surface is flatter. In FIG. 2, the thicknesses on an inner side spaced from the end surface of the thermistor body by about 10 μm or more are measured. While the second electrode layers may be formed using a sputtering method or a printing method, it is preferable to use the sputtering method, which makes simplifies film thickness control, and enables a flatter film to be formed.

Each of the third electrode layers is a single layer or a plurality of metal or alloy layers, and as the metal, Ni, Cu or Au, and as the alloy, alloys of these metals may preferably be used. For a single layer or an outermost layer, Cu or Au is preferable. This is because burning during laser light emission is effectively reduced or prevented. Moreover, a thickness of each of the third electrode layers is preferably about 5 μm or more and about 20 μm or less, and more preferably about 6 μm or more and about 15 μm or less, for example. The third electrode layer may preferably be formed using a plating method, for example.

Moreover, the thermistor body 2 includes non-covered regions that are not covered with the external electrodes on outer surfaces of a central portion thereof. For example, the one main surface 13 includes a covered region 13*a* covered with the external electrode 8, a covered region 13*b* covered with the external electrode 9, and a non-covered region 13*c* not covered with either of the external electrodes 8, 9. Moreover, the other main surface includes a covered region 13*d* covered with the external electrode 8, a covered region 13*e* covered with the external electrode 9, and a non-covered region 13*f* not covered with either of the external electrodes 8, 9. Here, sizes of the covered regions and the non-covered regions of the main surfaces may be selected in view of prevention of ruptures, such as a crack of an NTC thermistor element. For example, the sizes may be set so that the first external electrodes and the second external electrodes satisfy conditions described below. That is, if in a length direction of the thermistor 1 (a direction from the one end surface to the other end surface 12), an overall length of the thermistor 1 is L, a length of the first external electrode 8 (a length of the covered region) is E2, and a length of the second external electrode 9 (a length of the covered region) is E3, $(1/3)\times L \leq E2+E3 \leq (0.95\times L)$, and preferably $(2/3)\times L \leq E2+E3 \leq (0.90\times L)$, for example, is satisfied. While it is preferable that the length E2 of the first external electrode 8 and the length E3 of the second external electrode 9 are the same or substantially the same to facilitate production, the lengths E2 and E3 may be different.

Here, the overall length L of the thermistor 1 indicates a length between both the ends in the length direction of the thermistor 1. Moreover, the length E2 of the first external electrode 8 indicates a length between one end and another end of the first external electrode 8 in the length direction of the thermistor 1. Further, the length E3 of the second external electrode 9 indicates a length between one end and another end of the second external electrode 9 in the length direction of the thermistor 1. For example, if a size of the thermistor 1 is JIS standard 0603 size [(0.6±0.03) mm (the length direction)×(0.3±0.03) mm (a width direction)], L is preferably about 0.6 mm, and E2 and E3 are preferably each about 0.2 mm or more, for example. This satisfies $E2+E3 \geq (2/3)\times L$. A thickness of the thermistor 1 is preferably more than about 0.1 mm, and less than about 0.3 mm, for example. Moreover, the thickness of the thermistor 1 may preferably be about 0.3 mm or more, for example. The size of the thermistor 1 may preferably be a size in a range of JIS standard 0402 to 2012, for example.

Moreover, the non-covered regions 13*c*, 13*f* may preferably include step portions 15, 16, respectively, which are lower than the covered regions covered with the two external electrodes 8, 9. Step differences of the step portion 15 and the step portion 16 may be the same as or different from one another. The step difference is preferably about 1 μm or more and about 30 μm or less, and more preferably about 1 μm or more and about 15 μm or less, for example. In FIG. 1, a total of the step differences of the step portion 15 and the step portion 16 is defined by a difference between a thickness T2 of the thermistor body 2 (a thickness between the covered regions 13*a* and 13*d*) and a thickness T1 (a thickness between the non-covered regions 13*c* and 13*f*), and for example, each of the step differences may preferably be a value of almost about ½ of the above-described total of differences. The step portions may preferably be formed, for example, by polishing treatment, acid treatment, plating treatment, or grinding treatment. While in the figure, an example of one step is shown, a plurality of step portions may be provided.

As described above, according to a preferred embodiment of the present invention, the second electrode layer, which is thinner and flatter than the first electrode layer, and in which the one end is in contact with the first electrode layer, and the other end extends in the direction of the other end surface, is provided in each of the main surfaces, so that flat portions of the external electrodes are large. Therefore, since a strict accuracy of position is not required with respect to the laser light during the laser light emission, the component built-in type substrate is able to be produced with easier simplified processes.

As required, insulating layers may be provided so as to cover the non-covered regions 13*c*, 13*f*. A material for the insulating layers is not particularly limited, but proper synthetic resin, for example, may preferably be used.

The NTC thermistor element according to preferred embodiments of the present invention may be produced, for example, using a production method according to a preferred embodiment of the present invention described below, and the production method includes at least a step of producing a thermistor body including internal electrodes, and a step of forming external electrodes in the thermistor body.

In the step of producing the thermistor body, an organic binder is preferably added to row material powder calcined as required, and is mixed to be turned into a slurry state, and is then molded, using a doctor blading method or other suitable method to produce a ceramic green sheet. Subsequently, using the conductive paste for internal electrode, screen printing is performed on the ceramic green sheet to form an electronic pattern. Next, the plurality of ceramic green sheets on each of which the electrode pattern has been printed are layered, and then sandwiched by the ceramic green sheets on which no electrode pattern is printed from above and below to be press-bonded and produce a layered body. Subsequently, after the obtained layered body is subjected to debinding treatment, the resultant is fired to produce the thermistor body in which the internal electrodes and the thermistor body layers are alternately layered.

Figure 3A:
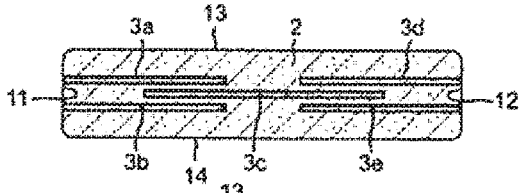
FIGS. 3A to 3D are schematic longitudinal cross-sectional views showing a method for producing the NTC thermistor to be embedded in a substrate according to a preferred embodiment of the present invention.
Figure 3B:
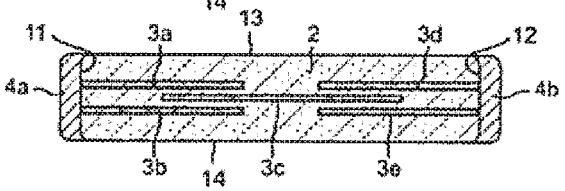
Figure 3C:
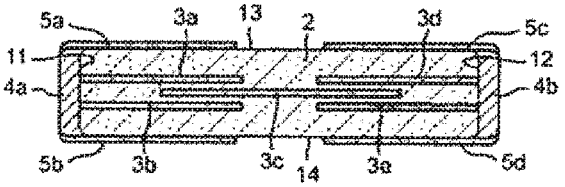
Figure 3D:
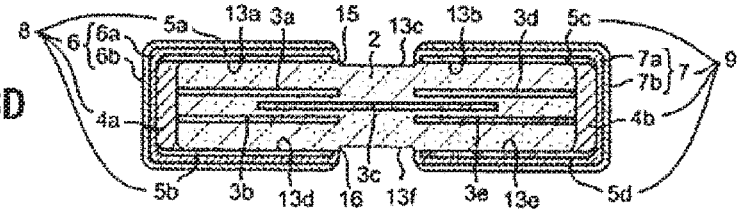

FIGS. 3A to 3D are schematic longitudinal cross-sectional views showing the step of forming the external electrodes of the thermistor element. In FIGS. 3A to 3D, the portions similar to those in FIG. 1 are denoted by the same reference characters, and descriptions thereof will be omitted. FIG. 3A is a schematic longitudinal cross-sectional view of the thermistor body 2 in which the internal electrodes 3*a*, 3*b*, 3*c*, 3*d*, 3*e* and the thermistor body layers are alternately layered. FIG. 3B shows a step of forming the first electrode layers of the external electrodes. The end surfaces 11, 12 of the thermistor body 2 in which the internal electrodes and the thermistor body layers are alternately laminated are immersed in the conductive paste, and are baked to form the first electrode layers 4*a*, 4*b*. FIG. 3C shows a step of forming the second electrode layers. By a sputtering method, the pair of second electrode layers 5*a*, 5*b* and the pair of second electrode layers 5*c*, 5*d* are formed on the respective main surfaces, wherein the one end of each of the second electrode layers 5*a*, 5*b* is in contact with the first electrode layer 4*a* and the other end thereof extends in the direction of the other end surface, and the one end of each of the second electrode layers 5*c*, 5*d* is in contact with the first electrode layer 4*b* and the other end thereof extends in the direction of the other end surface. FIG. 3D shows a step of forming the third electrode layers, and shows an example in which each of the third electrode layers includes two layers. A first layer 7*a* and a second layer 7*b* of the third electrode layer 7 are preferably formed, for example, by a plating method. This enables the NTC thermistor element to be produced.

Moreover, in the case where the step of forming the third electrode layers is a step of forming the third electrode layer by the plating method, after the second electrode layers are formed, body surface treatment, such as oxide treatment, polishing treatment, plating treatment, and grinding treatment may be applied to the non-covered regions, each of which is the outer surface at the central portion of the thermistor body, and is not covered with the second electrode layer. At this time, the step portions 15, 16 are formed. While in the case where the second electrode layers are formed using the sputtering method, there is a possibility that a portion of the electrode material adheres to the non-covered regions of the thermistor body, performing the above-described body surface treatment removes the portion of the electrode material when the step portions 15, 16 are formed. Thus, when the third electrode layers are formed using the plating method, an island-shaped plating is prevented from occurring in the non-covered regions of the thermistor body. For example, for the NTC thermistor element in the JIS standard 0603 size, between a case where the above-described body surface treatment is performed after the second electrode layers are formed by the sputtering method, and a case where the body surface treatment is not performed thereafter, the occurrence of the island-shaped plating is compared. When SEM observation is conducted on the non-covered regions of the thermistor body, in 1000 elements subjected to the above-described body surface treatment, the occurrence of the island-shaped plating having a diameter of about 0.5 μm or more is not observed. In contrast, in the case where the above-described surface treatment is not performed, in all of the 1000 elements, the occurrence of the island-shaped plating having a diameter of about 0.5 μm or more is observed.

Moreover, in the above-described example, the example in which the second electrode layers are used, using the sputtering method has been described. However, a screen printing method may be used to form the second electrode layers.

Figure 4A:
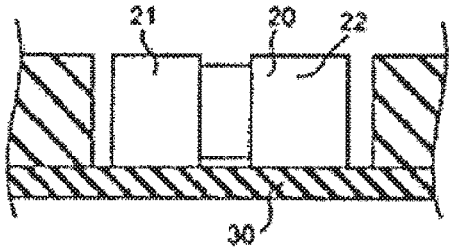
FIGS. 4A to 4D are schematic longitudinal cross-sectional views showing a method for mounting the NTC thermistor to be embedded in a substrate according to a preferred embodiment of the present invention on the component-embedded substrate.

FIGS. 4A to 4D are schematic longitudinal cross-sectional views showing one example of a step of mounting the NTC thermistor element on the component-embedded substrate. First, as shown in FIG. 4A, a thermistor element 20 is placed on a substrate 30. At this time, a first external electrode 21 and a second external electrode 22 are bonded to the substrate 30 through an adhesive agent.

Figure 4B:
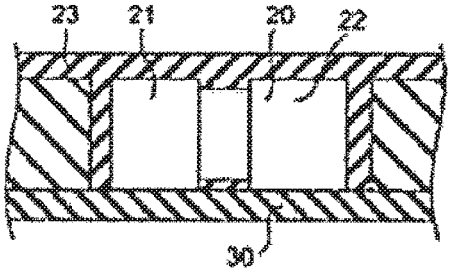

Next, as shown in FIG. 4B, a sealing body 23 is applied onto a surface of the substrate 30 so as to seal the thermistor element 20. This enables the thermistor element 20 to be embedded in the sealing body 23.

Figure 4C:
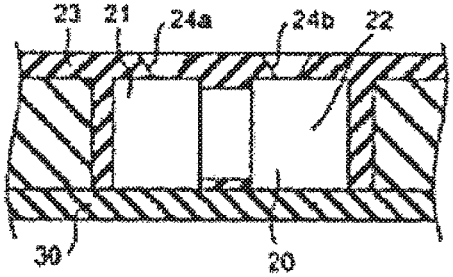

Next, as shown in FIG. 4C, the laser light is emitted to portions of the sealing body 23 immediately under which the first external electrode 21 and the second external electrode 22 are located, and a hole portion 24*a* through which the first external electrode 21 is exposed, and a hole portion 24*b* through which the second external electrode 22 is exposed are formed. At this time, since each of the second electrode layers, which is thinner and flatter than the first electrode layer, and in which the one end is in contact with the first electrode layer, and the other end extends in the direction of the other end surface, is provided on each of the main surfaces, a flat portion of each of the external electrodes becomes larger. Therefore, the strict accuracy of position is not required with respect to the laser light during the laser light emission, so that the component built-in type substrate can be produced with easier and simpler processes.

Figure 4D:
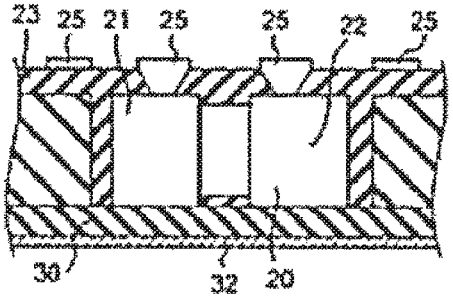
Figure 5:
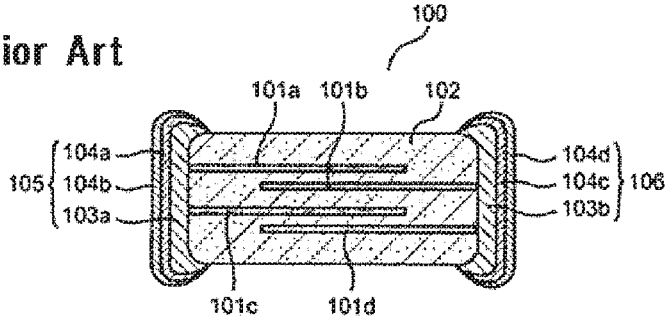
Fig.5 Prior Art
FIG. 5 is a schematic longitudinal cross-sectional view showing one example of a structure of a conventional NTC thermistor to be embedded in a substrate.

Next, as shown in FIG. 4D, the hole portions 24*a*, 24*b* of the sealing body 23 and the upper surface of the sealing body 23, and a back surface of the substrate 30 are plated with metal materials 25, 32 such as Cu, for example, as wiring. This enables insides of the hole portions 24*a*, 24*b* to be filled with the metal material. Further, an insulating layer and a conductive layer (not shown) are preferably laminated to produce the component built-in type substrate.

While NTC thermistors have been described in accordance with the above preferred embodiments of the present invention, additional preferred embodiments of the present invention may also be applied to a PTC thermistor having internal electrodes and external electrodes, which has been described, for example, in WO 2014/017365 A. That is, when preferred embodiments of the present invention are applied to a PTC thermistor, a substrate-embedded PTC thermistor is able to be provided that includes a thermistor body made of a ceramic sintered body, and including two opposed main surfaces, two opposed side surfaces, and two opposed end surfaces, a plurality of internal electrodes provided inside the thermistor body, and two external electrodes provided on outer surfaces of the thermistor body and electrically connected to the plurality of internal electrodes, wherein each of the external electrodes includes a first electrode layer covering one of the end surfaces of the thermistor body, a second electrode layer provided on each of the main surfaces of the thermistor body and including at least one layer, one end of the second electrode layer being in contact with the first electrode layer, and another end thereof extending in a direction of another end surface, and a third electrode layer including at least one layer and covering the first electrode layer and the second electrode layers. In this case, as in the NTC thermistor, an extremely high accuracy of position is not required when a via hole is formed by laser light. In the case of the PTC thermistor, ceramics having a positive resistance temperature characteristic may preferably be used for the thermistor body. Moreover, for the internal electrodes and the first electrode layers, the second electrode layers, and the third electrode layers of the external electrodes, the materials described above may preferably be used.

According to preferred embodiments of the present invention, NTC thermistors capable of being easily embedded in a component-embedded substrate are provided.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An NTC thermistor comprising:

a thermistor body that is a ceramic sintered body and includes two opposed main surfaces, two opposed side surfaces, and two opposed end surfaces;

a plurality of internal electrodes provided inside the thermistor body; and two external electrodes provided on outer surfaces of the thermistor body, and electrically connected to the plurality of internal electrodes; wherein each of the external electrodes includes:

a first electrode layer covering only one of the end surfaces of the thermistor body;

a second electrode layer provided on each of the two opposed main surfaces of the thermistor body, the second electrode layer including at least one layer, one end of the second electrode layer being in contact with the first electrode layer, and another end thereof extending in a direction of another end surface; and a third electrode layer including at least one layer and covering the first electrode and the second electrode layers.

2. The NTC thermistor according to claim 1, wherein each of the second electrode layers includes a sputtering film including at least one layer.

3. The NTC thermistor according to claim 1, wherein the third electrode layer is a plated film.

4. The NTC thermistor according to claim 1, wherein the first electrode layer is a fired conductive paste layer.

5. The NTC thermistor according to claim 1, wherein the second electrode layer is flatter than the first electrode layer.

6. The NTC thermistor according to claim 1, wherein the thermistor body includes a non-covered region that is not covered with the external electrodes on outer surfaces at a center portion thereof, and the non-covered region includes a step lower than a covered region covered with the external electrodes.

7. The NTC thermistor according to claim 1, wherein the thermistor body is a rectangular or substantially rectangular parallelepiped ceramic sintered body.

8. The NTC thermistor according to claim 1, wherein the thermistor body includes ceramics containing an oxide of at least one of Mn, Ni, Fe, Ti, Co, Al, and Zn.

9. The NTC thermistor according to claim 1, wherein the thermistor body includes ceramics containing manganese oxide as a principal component, and containing one or more of nickel oxide, cobalt oxide, alumina, iron oxide, and titanium oxide.

10. The NTC thermistor according to claim 1, wherein the first electrode layer includes one of Ag, Pd, Pt, and Au.

11. The NTC thermistor according to claim 1, wherein a thickness of the first electrode layer is about 10 μm or more and about 60 μm or less.

12. The NTC thermistor according to claim 1, wherein a thickness of the first electrode layer is about 10 μm or more and about 50 μm or less.

13. The NTC thermistor according to claim 1, wherein a thickness of the first electrode layer is about 15 μm or more and about 40 μm or less.

14. The NTC thermistor according to claim 1, wherein a thickness of the second electrode layers is about 0.5 μm or more and about 10 μm or less.

15. The NTC thermistor according to claim 1, wherein a thickness of the second electrode layers is about 1 μm or more and about 10 μm or less.

16. The NTC thermistor according to claim 1, wherein a thickness of the second electrode layers is about 1.5 μm or more and about 5 μm or less.

17. The NTC thermistor according to claim 1, wherein a thickness of the third electrode layers is about 5 μm or more and about 20 μm or less.

18. A method for producing the NTC thermistor of claim 1, the method comprising:

a step of forming each of the external electrodes; wherein the step of forming each of the external electrodes further comprises:

a step of forming a first electrode layer covering only one end surface of a thermistor body;

a step of forming a second electrode layer formed on each main surface of the thermistor body and including at least one layer, one end of the second electrode layer being in contact with the first electrode layer, and another end thereof extending in a direction of another end surface; and a step of forming a third electrode layer including at least one layer and covering the first electrode layer and the second electrode layers.

19. The method according to claim 18, wherein the step of forming the third electrode layer includes a step of forming the third electrode layer by a plating method, and after forming the second electrode layers, for a non-covered region of the outer surfaces at the central portion of the thermistor body that is not covered with the second electrode layer, removal of the body surface portion is performed.

20. The method according to claim 18, wherein in the step of forming the second electrode layer, the second electrode layer is formed so as to be flatter than the first electrode layer.

* * * * *